US010378717B2

(12) United States Patent
Sone

(10) Patent No.: US 10,378,717 B2
(45) Date of Patent: Aug. 13, 2019

(54) OPTICAL UNIT HAVING A ROTATING REFLECTOR FOR A VEHICLE LAMP

(71) Applicant: KOITO MANUFACTURING CO., LTD., Tokyo (JP)

(72) Inventor: Hidemichi Sone, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 15/789,149

(22) Filed: Oct. 20, 2017

(65) Prior Publication Data

US 2018/0112843 A1 Apr. 26, 2018

(30) Foreign Application Priority Data

Oct. 20, 2016 (JP) ..... 2016-205883

(51) Int. Cl.

| | |
|---|---|
| ***F21S 41/00*** | (2018.01) |
| ***F21S 41/39*** | (2018.01) |
| ***F21S 41/675*** | (2018.01) |
| ***F21S 41/36*** | (2018.01) |
| ***F21S 41/255*** | (2018.01) |
| ***F21S 41/32*** | (2018.01) |
| ***F21S 41/33*** | (2018.01) |

(Continued)

(52) U.S. Cl.

CPC ..... *F21S 41/39* (2018.01); *F21S 41/148* (2018.01); *F21S 41/255* (2018.01); *F21S 41/321* (2018.01); *F21S 41/336* (2018.01); *F21S 41/36* (2018.01); *F21S 41/663* (2018.01); *F21S 41/675* (2018.01); *F21S 41/141* (2018.01); *F21W 2102/14* (2018.01); *F21Y 2115/10* (2016.08)

(58) Field of Classification Search

CPC .. F21S 48/1305; F21S 48/138; F21S 48/1757; F21S 41/39; F21S 41/675

See application file for complete search history.

(56) References Cited

U.S. PATENT DOCUMENTS

| | | | | |
|---|---|---|---|---|
| 6,341,884 | B1 | 1/2002 | Leleve et al. | |
| 2005/0078488 | A1* | 4/2005 | Oyama ..... | B60Q 1/12 362/517 |

(Continued)

FOREIGN PATENT DOCUMENTS

| | | |
|---|---|---|
| EP | 2559935 A1 | 2/2013 |
| FR | 2767903 A1 | 3/1999 |

(Continued)

OTHER PUBLICATIONS

Preliminary Search Report issued in French Application No. 1759882, dated Apr. 29, 2019 (9 pages).

*Primary Examiner* — Gerald J Sufleta, II

(74) *Attorney, Agent, or Firm* — Osha Liang LLP

(57) ABSTRACT

An optical unit includes a rotary reflector rotating in one direction around its rotation axis while reflecting light emitted from a light source. The rotary reflector is provided with a plurality of reflecting surfaces such that light of the light source reflected by the rotary reflector rotating is configured to form a desired light distribution pattern. Each of the reflecting surfaces includes a first reflecting surface configured to form a first partial region of the light distribution pattern, and a second reflecting surface configured to form a second partial region of the light distribution pattern different from the first partial region.

7 Claims, 9 Drawing Sheets

(51) Int. Cl.

| | |
|---|---|
| ***F21S 41/663*** | (2018.01) |
| ***F21S 41/148*** | (2018.01) |
| *F21Y 115/10* | (2016.01) |
| *F21S 41/141* | (2018.01) |
| *F21W 102/14* | (2018.01) |

(56) References Cited

U.S. PATENT DOCUMENTS

| | | | | |
|---|---|---|---|---|
| 2009/0015388 | A1* | 1/2009 | Yagi | B60Q 1/0035 340/435 |
| 2013/0038736 | A1* | 2/2013 | Yamamura | B60Q 1/143 348/148 |
| 2017/0159903 | A1 | 6/2017 | Yamamura | |
| 2017/0159904 | A1 | 6/2017 | Yamamura | |
| 2017/0185855 | A1 | 6/2017 | Yamamura | |

FOREIGN PATENT DOCUMENTS

| | | | |
|---|---|---|---|
| JP | H11-202236 | A | 7/1999 |
| JP | H11-295632 | A | 10/1999 |
| WO | 2011/129105 | A1 | 10/2011 |

* cited by examiner

OPTICAL UNIT HAVING A ROTATING REFLECTOR FOR A VEHICLE LAMP

CROSS-REFERENCE TO RELATED APPLICATION

This application claims priority from Japanese Patent Application No. 2016-205883 filed on Oct. 20, 2016, the entire contents of which are incorporated herein by reference.

FIELD

The present invention relates to an optical unit, and particularly, to an optical unit used for a vehicle lamp.

BACKGROUND

Recently, an optical unit including a rotary reflector that rotates in one direction around its rotation axis while reflecting light emitted from a light source has been devised (see JPWO 2011129105 (A1)).

This optical unit can form a light distribution pattern partially shielded by controlling the timing of the turning on/off of the light source while scanning the front side of the optical unit with a light source image.

However, in the above-described optical unit, all of the scanning regions that can be scanned by the reflected light reflected in each of a plurality of blades are the same. Therefore, in the scanning regions, an irradiated region and a non-irradiated region divided in a scanning direction can be formed, but an irradiated region and a non-irradiated region divided in a direction intersecting with the scanning direction cannot be formed.

SUMMARY

The present invention has been made in consideration of such situations, and an object thereof is to provide a technique capable of forming an irradiated region and a non-irradiated region divided in a direction intersecting with a scanning direction in a light distribution pattern formed by an optical unit.

In order to solve the above problem, an optical unit according to one aspect of the present invention includes a rotary reflector rotating in one direction around its rotation axis while reflecting light emitted from a light source. The rotary reflector is provided with a plurality of reflecting surfaces such that light of the light source reflected by the rotary reflector rotating is configured to form a desired light distribution pattern. Each of the reflecting surfaces has a first reflecting surface configured to form a first partial region of the light distribution pattern, and a second reflecting surface configured to form a second partial region of the light distribution pattern different from the first partial region.

According to this aspect, the light distribution pattern has the first partial region formed by the light of the light source reflected by the first reflecting surface, and the second partial region formed by the light of the light source reflected by the second reflecting surface. Therefore, for example, by causing a non-irradiated region (irradiated region) in a scanning direction of the first partial region and a non-irradiated region (irradiated region) in the scanning direction of the second partial region to be deviated from each other, the irradiated region and the non-irradiated region divided in the direction intersecting with the scanning direction can be formed.

In the rotary reflector, the number of the first reflecting surfaces and the number of the second reflecting surfaces may be the same. In this way, the center of gravity of the rotary reflector is easily brought close to the rotation axis, so that the eccentricity during rotation of the rotary reflector can be suppressed.

The rotary reflector may be provided with four or more reflecting surfaces. In this way, a plurality of first reflecting surfaces and a plurality of second reflecting surfaces can be provided. As a result, since the first partial region is scanned multiple times and the second partial region is scanned multiple times while the rotary reflector makes one revolution, the scanning frequency can be increased.

In the rotary reflector, the first reflecting surfaces and the second reflecting surfaces may be provided alternately in a circumferential direction. In this way, the eccentricity during rotation of the rotary reflector can be further suppressed.

In the rotary reflector, a blade serving as the reflecting surface may be provided around the rotation axis, and the blade may have a shape in which an angle formed by an optical axis and the reflecting surface changes along the circumferential direction around the rotation axis.

Meanwhile, any combination of the above-described components and the transformation of the expression of the present invention among methods, devices and systems or the like are also effective as aspects of the present invention. Further, any suitable combination of the above-described parts can be also included in the scope of the invention to be sought by the present patent application.

According to the present invention, the irradiated region and the non-irradiated region divided in the direction intersecting with the scanning direction can be formed in the light distribution pattern formed by the optical unit.

EMBODIMENTS

Figure 1:
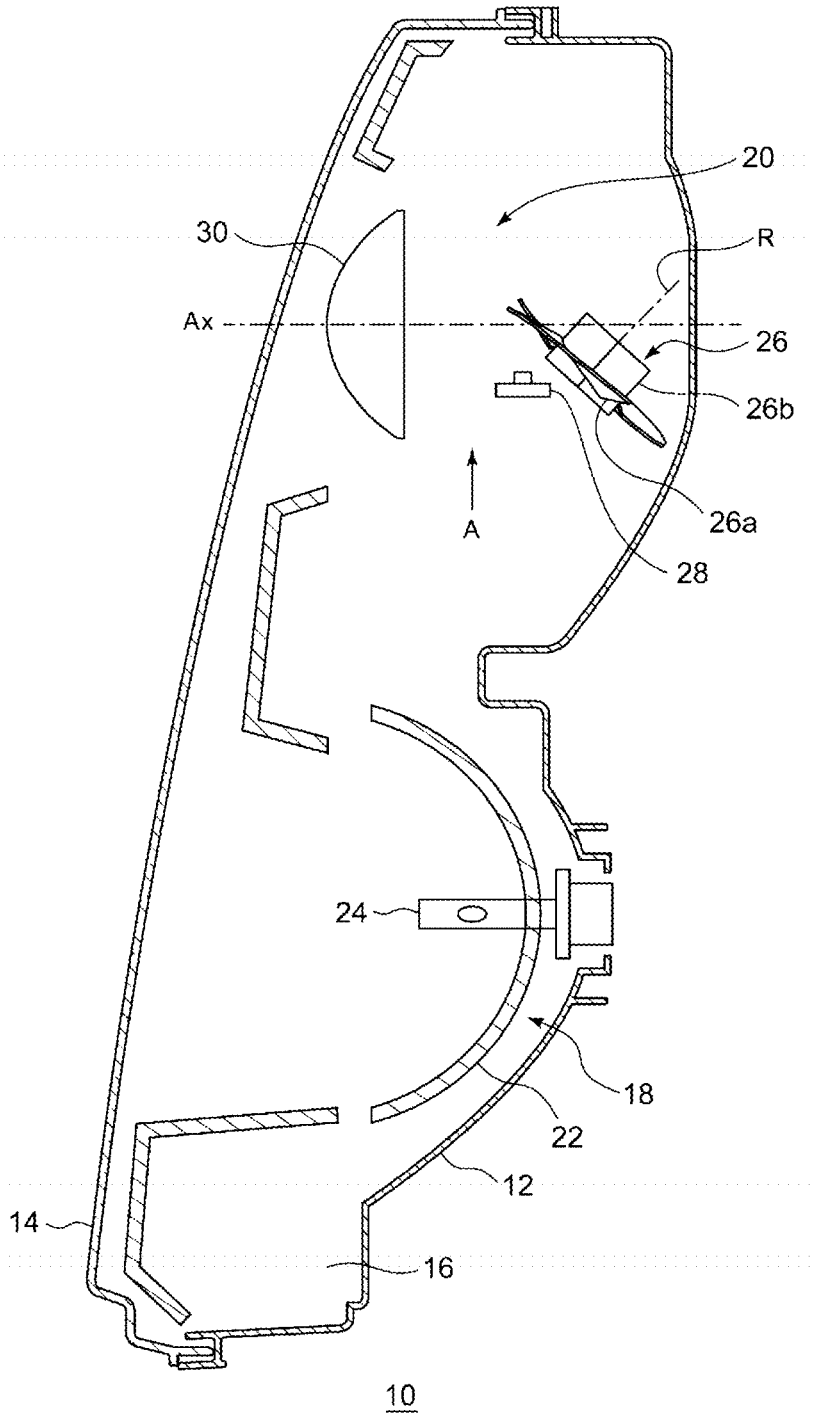
FIG. 1 is a horizontal sectional view of a vehicle headlamp according to a reference example.

Hereinafter, based on reference examples and embodiments, the present invention will be described with reference to the drawings. The same or similar constituent elements, members or processes shown in each drawing are denoted by the same reference numerals, and the repeated explanations are omitted as appropriate. Further, the embodiments are not intended to limit the invention but are examples. All the features described in the embodiments and combinations thereof are not necessarily essential to the invention.

An optical unit of the present invention can be used for various vehicle lamps. Hereinafter, a case where the optical unit of the present invention is applied to a vehicle headlamp of a vehicle lamp will be described.

Reference Example

First, a basic configuration and a basic operation of an optical unit according to the present embodiment will be described with reference to a reference example. FIG. 1 is a horizontal sectional view of a vehicle headlamp according to the reference example. A vehicle headlamp 10 shown in FIG. 1 is a right headlamp mounted on the right side of a front end portion of an automobile and has the same structure as a left headlamp mounted on the left side except that it is bilaterally symmetrical with the left headlamp. Therefore, hereinafter, the right vehicle headlamp 10 will be described in detail, and the description of the left vehicle headlamp will be omitted.

As shown in FIG. 1, the vehicle headlamp 10 includes a lamp body 12 having a recess opening forward. The front opening of the lamp body 12 is covered with a transparent front cover 14, thereby forming a lamp chamber 16. The lamp chamber 16 functions as a space in which two lamp units 18, 20 are accommodated in a state of being arranged side by side in a vehicle width direction.

Out of the lamp units, the lamp unit disposed on the outer side, i.e., the lamp unit 20 disposed on the upper side in FIG. 1 in the right vehicle headlamp 10 is a lamp unit including a lens. The lamp unit 20 is configured to irradiate a variable high beam. On the other hand, out of the lamp units, the lamp unit disposed on the inner side, i.e., the lamp unit 18 disposed on the lower side in FIG. 1 in the right vehicle headlamp 10 is configured to irradiate a low beam.

The low-beam lamp unit 18 includes a reflector 22, a light source bulb (incandescent bulb) 24 supported on the reflector 22, and a shade (not shown). The reflector 22 is supported tiltably with respect to the lamp body 12 by known means (not shown), for example, means using an aiming screw and a nut.

As shown in FIG. 1, the lamp unit 20 includes a rotary reflector 26, an LED 28, and a convex lens 30 as a projection lens disposed in front of the rotary reflector 26. Meanwhile, instead of the LED 28, a semiconductor light emitting element such as an EL element or an LD element can be used as the light source. Particularly for the control of shielding a part of a light distribution pattern (to be described later), it is desirable to use a light source capable of precisely performing the turning on/off in a short time. Although the shape of the convex lens 30 can be appropriately selected according to the light distribution characteristics such as light distribution patterns or illuminance patterns required, an aspherical lens or a free-curved surface lens is used. In the reference example, an aspherical lens is used as the convex lens 30.

The rotary reflector 26 rotates in one direction around its rotation axis R by a drive source such as a motor (not shown). Further, the rotary reflector 26 has a reflecting surface configured to reflect light emitted from the LED 28 while rotating and to form a desired light distribution pattern.

Figure 2:
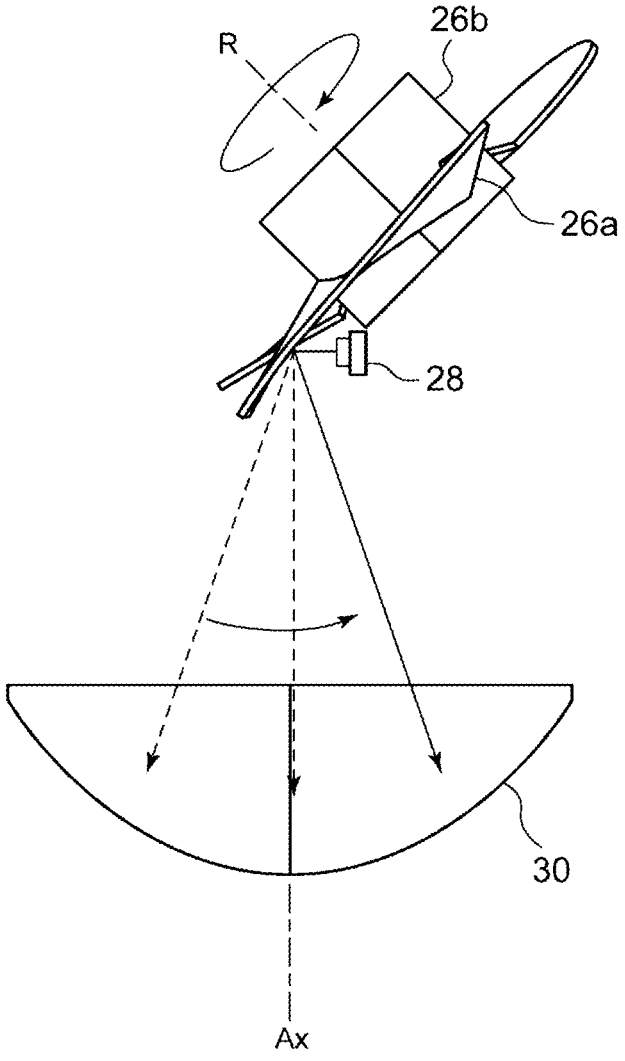
FIG. 2 is a top view schematically showing a configuration of a lamp unit including an optical unit according to the reference example.
Figure 3:
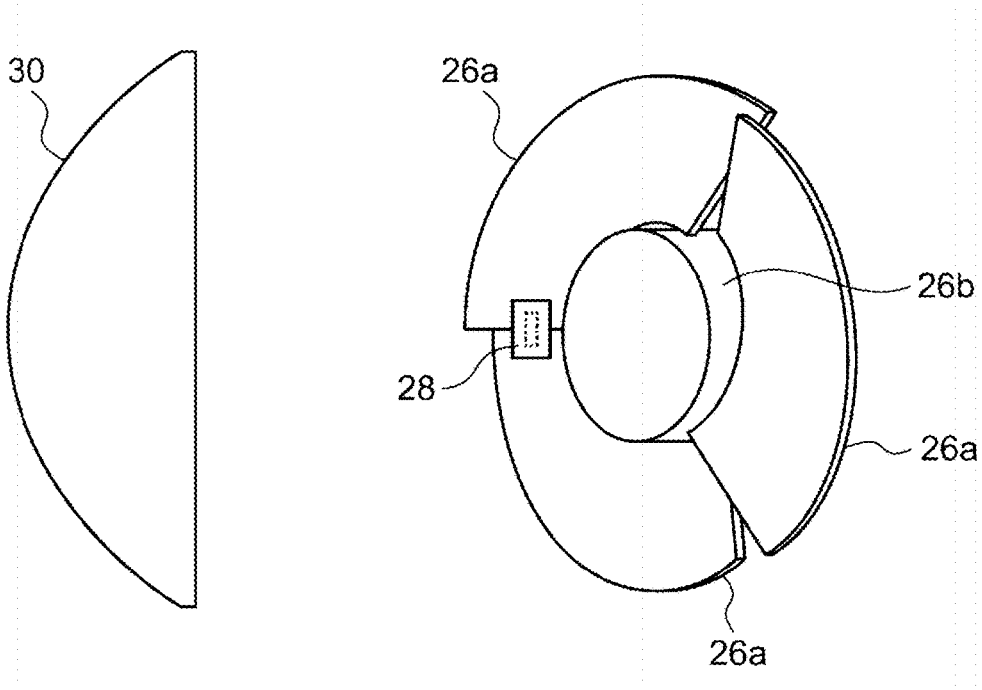
FIG. 3 is a side view of the lamp unit, as seen from the direction "A" shown in FIG. 1.

FIG. 2 is a top view schematically showing a configuration of the lamp unit 20 including the optical unit according to the reference example. FIG. 3 is a side view of the lamp unit 20, as seen from the direction "A" shown in FIG. 1.

The rotary reflector 26 is configured such that three blades 26*a* serving as the reflecting surface and having the same shape are provided around a cylindrical rotating part 26*b*. The rotation axis R of the rotary reflector 26 is oblique to an optical axis Ax and is provided in a plane including the optical axis Ax and the LED 28. In other words, the rotation axis R is provided substantially in parallel with a scanning plane of the light (irradiation beam) of the LED 28 which scans in a right and left direction by rotation. In this way, the thickness of the optical unit can be reduced. Here, the scanning plane can be regarded as a fan-shaped plane that is formed by continuously connecting the locus of the light of the LED 28 that is the scanning light, for example. Further, in the lamp unit 20 according to the reference example, the LED 28 provided is relatively small, and the position where the LED 28 is disposed is located between the rotary reflector 26 and the convex lens 30 and is deviated from the optical axis Ax. Therefore, the dimension in a depth direction (a vehicle front-rear direction) of the vehicle headlamp 10 can be shortened, as compared with the case where a light source, a reflector, and a lens are arranged in a line on an optical axis as in a conventional projector-type lamp unit.

Further, the shapes of the blades 26*a* of the rotary reflector 26 are configured such that a secondary light source of the LED 28 due to reflection is formed near a focal point of the convex lens 30. In addition, each of the blades 26*a* has a shape twisted so that an angle formed by the optical axis Ax and the reflecting surface changes along a circumferential direction around the rotation axis R. In this way, as shown in FIG. 2, the scanning using the light of the LED 28 becomes possible. This point will be described in more detail.

FIGS. 4A to 4E are perspective views showing the states of the blades according to a rotation angle of the rotary reflector 26 in the lamp unit according to the reference example, and FIGS. 4F to 4J are views for explaining that the reflection direction of light from a light source changes in accordance with the states shown in FIGS. 4A to 4E.

Figure 4A:
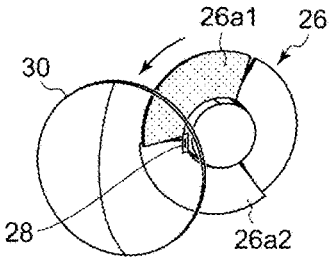
FIGS. 4A to 4E are perspective views showing the states of a blade according to a rotation angle of a rotary reflector in the lamp unit according to the reference example.
Figure 4B:
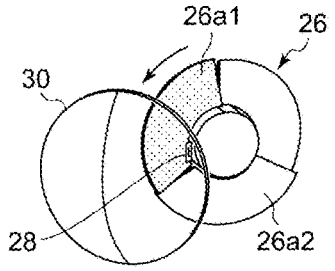

FIG. 4A shows a state in which the LED 28 is disposed so as to irradiate a boundary region between two blades 26*a*1, 26*a*2. In this state, as shown in FIG. 4F, the light of the LED 28 is reflected by a reflecting surface S of the blade 26*a*1 in a direction oblique to the optical axis Ax. As a result, one end region of both right and left end portions among the regions in front of the vehicle where the light distribution pattern is formed is irradiated. Therefore, when the rotary reflector 26 rotates to the state shown in FIG. 4B, the reflecting surface S (reflecting angle) of the blade 26*a*1 reflecting the light of the LED 28 changes because the blade 26*a*1 is twisted. As a result, as shown in FIG. 4G, the light of the LED 28 is reflected in a direction closer to the optical axis Ax than the reflecting direction shown in FIG. 4F.

Figure 4C:
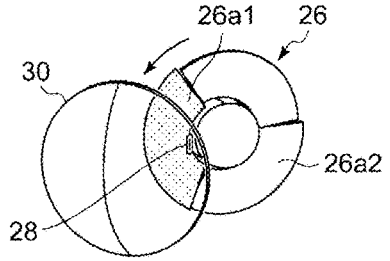
Figure 4D:
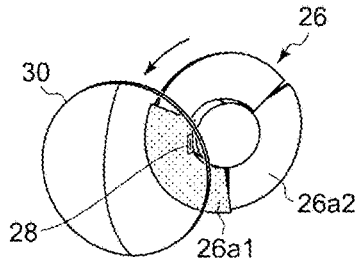
Figure 4E:
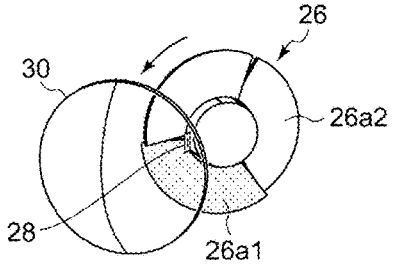
Figure 4F:
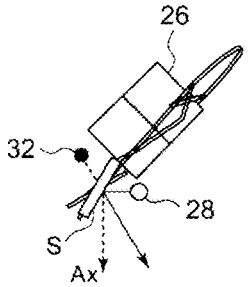
FIGS. 4F to 4J are views for explaining that the reflection direction of light from a light source changes in accordance with the states shown in FIGS. 4A to 4E.
Figure 4G:
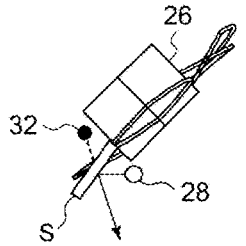
Figure 4H:
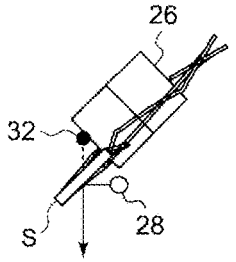
Figure 4I:
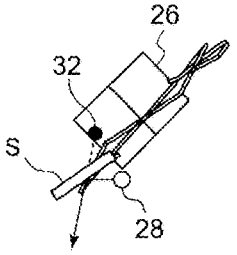
Figure 4J:
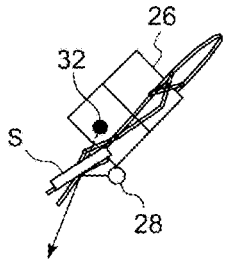
Figure 5A:
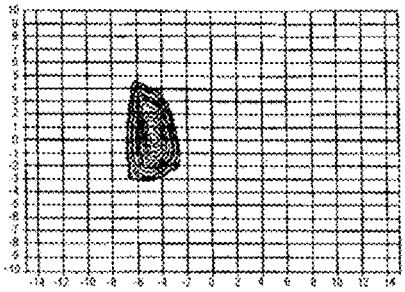
FIGS. 5A to 5E are views showing projection images at scanning positions where the rotary reflector corresponds to the states shown in FIGS. 4F to 4J.
Figure 5B:
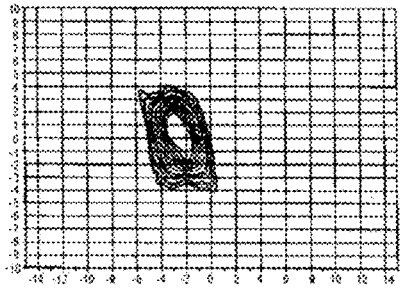
Figure 5C:
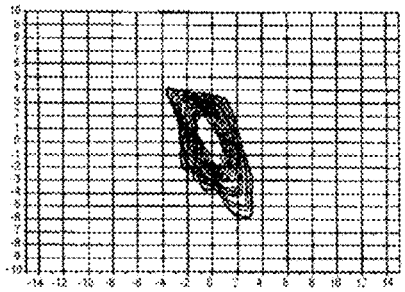
Figure 5D:
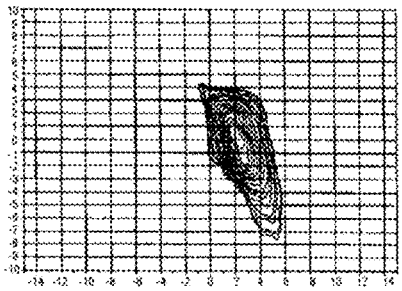
Figure 5E:
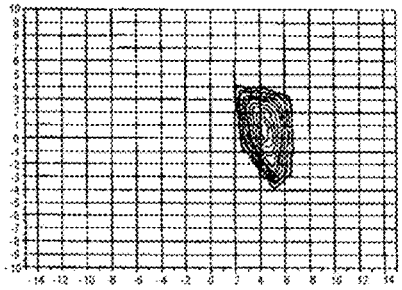

Subsequently, when the rotary reflector 26 is rotated as shown in FIGS. 4C, 4D and 4E, the reflecting direction of the light of the LED 28 changes toward the other end portion of the both right and left end portions among the regions in front of the vehicle where the light distribution pattern is formed. The rotary reflector 26 according to the reference example is configured such that it can scan the front side once in one direction (horizontal direction) by the light of the LED 28 by being rotated by 120 degrees. In other words, as one blade 26*a* passes in front of the LED 28, a desired region in front of the vehicle is scanned once by the light of the LED 28. Meanwhile, as shown in FIGS. 4F to 4J, a secondary light source (light source virtual image) 32 moves right and left near the focal point of the convex lens 30. The number and shape of the blades 26*a* and the rotational speed of the rotary reflector 26 are appropriately set based on the results of experiments or simulations in consideration of required characteristics of the light distribution pattern or the flicker of the image to be scanned. Further, a motor is desirable as a drive unit that can change its rotational speed according to various light distribution control. Thus, it is possible to easily change the scanning timing. As such a motor, a motor capable of obtaining rotation timing information from the motor itself is desirable. Specifically, a DC brushless motor can be used. When the DC brushless motor is used, the rotation timing information can be obtained from the motor itself, and thus, equipment such as an encoder can be omitted.

In this way, the rotary reflector 26 according to the reference example can scan the front side of the vehicle in the right and left direction using the light of the LED 27 by devising the shape and rotational speed of the blade 26*a*. FIGS. 5A to 5E are views showing projection images at scanning positions where the rotary reflector corresponds to the states shown in FIGS. 4F to 4J. The units on the vertical axis and the horizontal axis in these figures are degrees (°), which indicate the irradiation range and the irradiation position. As shown in FIGS. 5A to 5E, the rotation of the rotary reflector 26 causes the projection image to move in the horizontal direction.

Figure 6A:
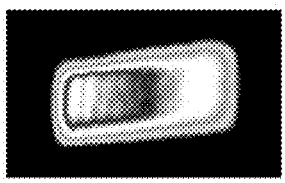
FIG. 6A is a view showing a light distribution pattern when a range of ±5 degrees in a right and left direction with respect to an optical axis is scanned using the vehicle headlamp according to the reference example.
Figure 6C:
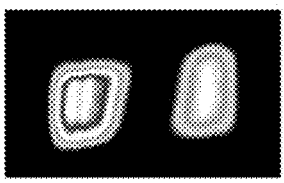
FIG. 6C is a view showing a state in which one portion of the light distribution pattern is shielded using the vehicle headlamp according to the reference example.
Figure 6E:
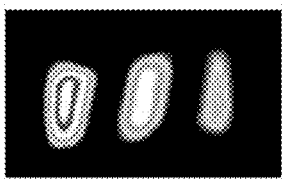
FIG. 6E is a view showing a state in which a plurality of portions of the light distribution pattern is shielded using the vehicle headlamp according to the reference example.
Figure 6B:
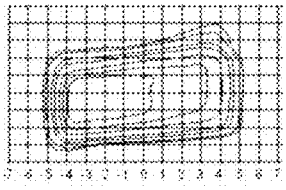
FIG. 6B is a view showing the luminous intensity distribution of the light distribution pattern shown in FIG. 6A.
Figure 6D:
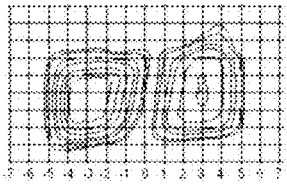
FIG. 6D is a view showing the luminous intensity distribution of the light distribution pattern shown in FIG. 6C.
Figure 6F:
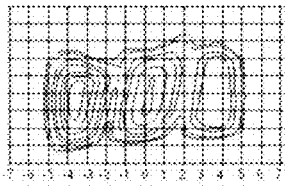
FIG. 6F is a view showing the luminous intensity distribution of the light distribution pattern shown in FIG. 6E.

FIG. 6A is a view showing the light distribution pattern when a range of ±5 degrees in the right and left direction with respect to the optical axis is scanned using the vehicle headlamp according to the reference example, FIG. 6B is a view showing the luminous intensity distribution of the light distribution pattern shown in FIG. 6A, FIG. 6C is a view showing a state in which one portion of the light distribution pattern is shielded using the vehicle headlamp according to the reference example, FIG. 6D is a view showing the luminous intensity distribution of the light distribution pattern shown in FIG. 6C, FIG. 6E is a view showing a state in which a plurality of places of the light distribution pattern is shielded using the vehicle headlamp according to the reference example, and FIG. 6F is a view showing the luminous intensity distribution of the light distribution pattern shown in FIG. 6E.

As shown in FIG. 6A, the vehicle headlamp 10 according to the reference example reflects the light of the LED 28 by the rotary reflector 26 and scans the front side with the reflected light, thereby forming a high-beam light distribution pattern that is laterally elongated substantially in the horizontal direction. In this way, since a desired light distribution pattern can be formed by rotation in one direction of the rotary reflector 26, driving by a special mechanism such as a resonance mirror is not necessary and restrictions on the size of the reflecting surface are small like the resonance mirror. Therefore, by selecting the rotary reflector 26 having a larger reflecting surface, the light emitted from the light source can be efficiently used for illumination. That is, the maximum light intensity in the light distribution pattern can be increased. Meanwhile, the rotary reflector 26 according to the reference example has substantially the same diameter as the convex lens 30, and the area of the blade 26*a* can be increased accordingly.

Further, the vehicle headlamp 10 including the optical unit according to the reference example can form a high-beam light distribution pattern in which an arbitrary region is shielded as shown in FIGS. 6C and 6E by synchronizing the timing of the turning on/off of the LED 28 and the changes in the light-emission luminous intensity with the rotation of the rotary reflector 26. Further, when the high-beam light distribution pattern is formed by changing (turning on/off the LED) the light-emission luminous intensity of the LED 28 in synchronous with the rotation of the rotary reflector 26, it is also possible to perform a control of swiveling the light distribution pattern itself by deviating the phase of the changes in the luminous intensity.

As described above, in the vehicle headlamp according to the reference example, the light distribution pattern is formed by scanning the light of the LED, and the light-shielding portion can be arbitrarily formed on a part of the light distribution pattern by controlling the changes in the light-emission luminous intensity. Therefore, it is possible to precisely shield a desired region by a small number of LEDs, as compared to the case where the light-shielding portion is formed by turning off some of a plurality of LEDs. Further, since the vehicle headlamp 10 can form a plurality of light-shielding portions, it is possible to shield the region corresponding to each vehicle even when a plurality of vehicles is present in front.

Further, since the vehicle headlamp 10 can perform the light-shielding control without moving the basic light distribution pattern, it is possible to reduce the sense of discomfort given to a driver during the light-shielding control. Further, since the light distribution pattern can be swiveled without moving the lamp unit 20, the mechanism of the lamp unit 20 can be simplified. Therefore, the vehicle headlamp 10 only needs to include a motor necessary for the rotation of the rotary reflector 26 as a drive part for variable light distribution control, so that the simplified configuration, the cost reduction and the miniaturization can be achieved.

First Embodiment

In the rotary reflector 26 included in the lamp unit 20 according to the above-described reference example, three blades 26*a* having the same shape are provided on the outer periphery of the rotating part 26*b*. Therefore, the rotary reflector 26 is configured such that it can scan the front side once in one direction (horizontal direction) by the light of the LED 28 by being rotated by 120 degrees. In other words, when the rotary reflector 26 makes one revolution, the same region on the front side is scanned three times by the light of the LED 28. Therefore, by controlling the turning on/off of the LED 28, a high-beam light distribution pattern in which an irradiated region and a non-irradiated region are alternately arranged in the scanning direction can be formed as shown in FIGS. 6C and 6E, but a light distribution pattern in which an irradiated region and a non-irradiated region are arranged in the direction intersecting with the scanning direction (direction orthogonal to the scanning direction) cannot be formed.

Therefore, in the optical unit according to the first embodiment, the front regions to be scanned by the light of the light source reflected by each of the reflecting surfaces do not become the same by devising the shape and arrangement of a plurality of reflecting surfaces included in the rotary reflector.

Figure 7A:
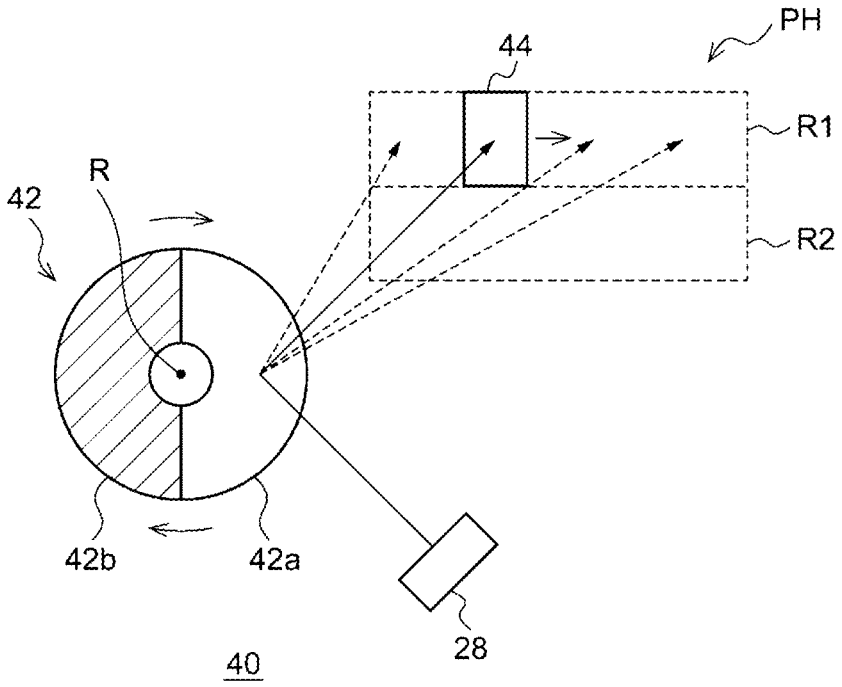
FIGS. 7A and 7B are schematic views for explaining the formation of a light distribution pattern by an optical unit according to a first embodiment.
Figure 7B:
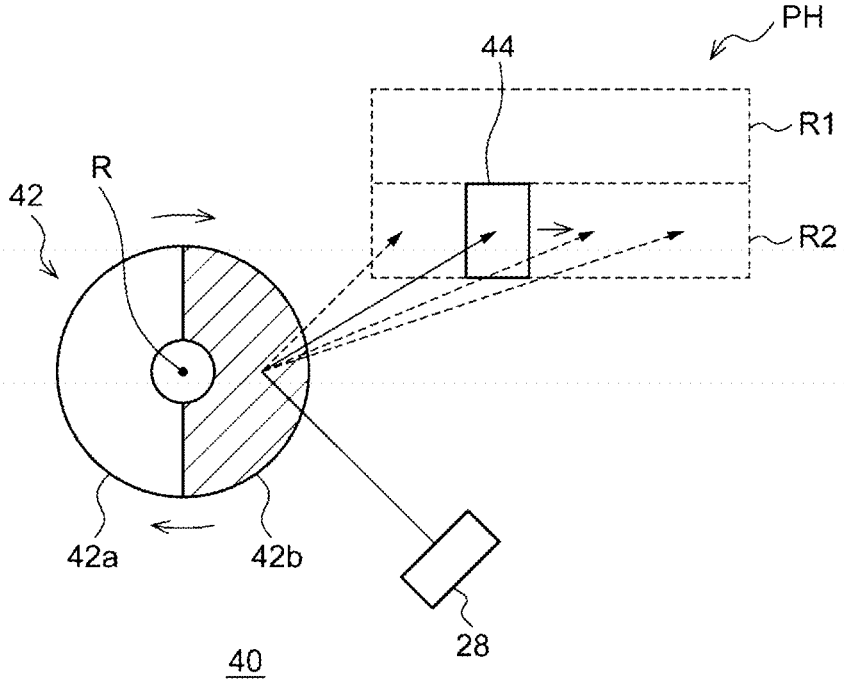

FIGS. 7A and 7B are schematic views for explaining the formation of a light distribution pattern by the optical unit according to the first embodiment.

An optical unit 40 according to the first embodiment includes a rotary reflector 42 rotating in one direction around its rotation axis while reflecting the light emitted from the LED 28 that is a light source. The rotary reflector 42 is provided with a plurality of reflecting surfaces 42*a*, 42*b* such that the light of the LED 28 reflected by the rotary reflector rotating forms a desired light distribution pattern PH. The reflecting surfaces have a first reflecting surface 42*a* forming a first partial region R1 located at the upper side of the light distribution pattern PH and a second reflecting surface 42*b* forming a second partial region R2 different from the first partial region R1 and located at the lower side of the light distribution pattern PH.

The first reflecting surface 42*a* reflects the light emitted from the LED 28 and scans the first partial region R1 shown in FIG. 7A as a light source image 44 from left to right. When the rotary reflector 42 is further rotated, as shown in FIG. 7B, the second reflecting surface 42*b* reflects the light emitted from the LED 28 and scans the second partial region R2 shown in FIG. 7B as the light source image 44 from left to right.

In this way, the light distribution pattern PH is a combination of the first partial region R1 formed by scanning the light of the LED 28 reflected by the first reflecting surface 42*a* and the second partial region R2 formed by scanning the light of the LED 28 reflected by the second reflecting surface 42*b*. Meanwhile, in the light distribution pattern PH shown in FIGS. 7A and 7B, the first partial region R1 and the second partial region R2 are arranged adjacent to each other. However, the first partial region R1 and the second partial region R2 may partially overlap with each other.

Further, the shapes of the first reflecting surface 42*a* and the second reflecting surface 42*b* are different from each other. More specifically, each of the first reflecting surface 42*a* and the second reflecting surface 42*b* has a shape twisted so that an angle formed by the rotation axis R and the reflecting surfaces changes along the circumferential direction around the rotation axis R. Additionally, in the first reflecting surface 42*a* and the second reflecting surface 42*b*, angles formed by the rotation axis R and each reflecting surface and ratios of changes in these angles are different from each other.

Figure 8:
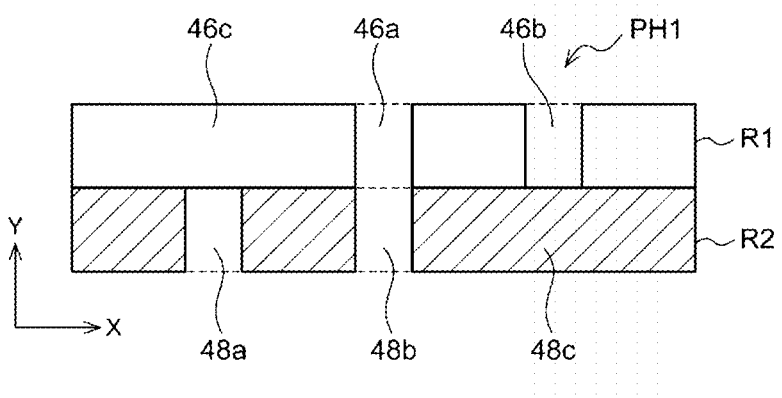
FIG. 8 is a schematic view showing a high-beam light distribution pattern in which a predetermined region is shielded, by the optical unit according to the first embodiment.

FIG. 8 is a schematic view showing a high-beam light distribution pattern in which a predetermined region is shielded, by the optical unit according to the first embodiment. In a high-beam light distribution pattern PH1 shown in FIG. 8, light-shielding portions 46*a*, 46*b* are formed by controlling the turning on/off of the LED 28 when scanning the first partial region R1 with the light reflected by the first reflecting surface 42*a* of the rotary reflector 42, and light-shielding portions 48*a*, 48*b* are formed by controlling the turning on/off of the LED 28 when scanning the second partial region R2 with the light reflected by the second reflecting surface 42*b*.

In this way, by causing the light-shielding portions 46*a*, 46*b* (non-irradiated regions) in a scanning direction X of the first partial region R1 and the light-shielding portions 48*a*, 48*b* (non-irradiated regions) in the scanning direction X of the second partial region R2 to be deviated from each other, the irradiated region 46*c* (or irradiated region 48*c*) and the light-shielding portion 48*a* (or the light-shielding portion 46*b*) divided in a direction Y intersecting with the scanning direction can be formed.

Further, in the rotary reflector 42, the number of the first reflecting surfaces 42*a* and the number of the second reflecting surfaces 42*b* are the same. In this way, the center of gravity of the rotary reflector 42 is easily brought close to the rotation axis R, so that the eccentricity during rotation of the rotary reflector 42 can be suppressed.

Second Embodiment

Figure 9A:
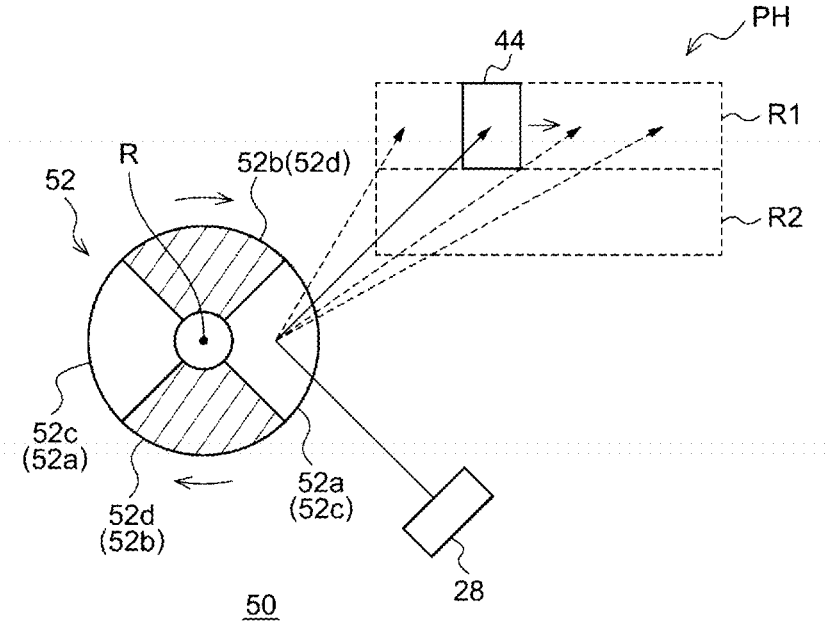
FIGS. 9A and 9B are schematic views for explaining the formation of a light distribution pattern by an optical unit according to a second embodiment.
Figure 9B:
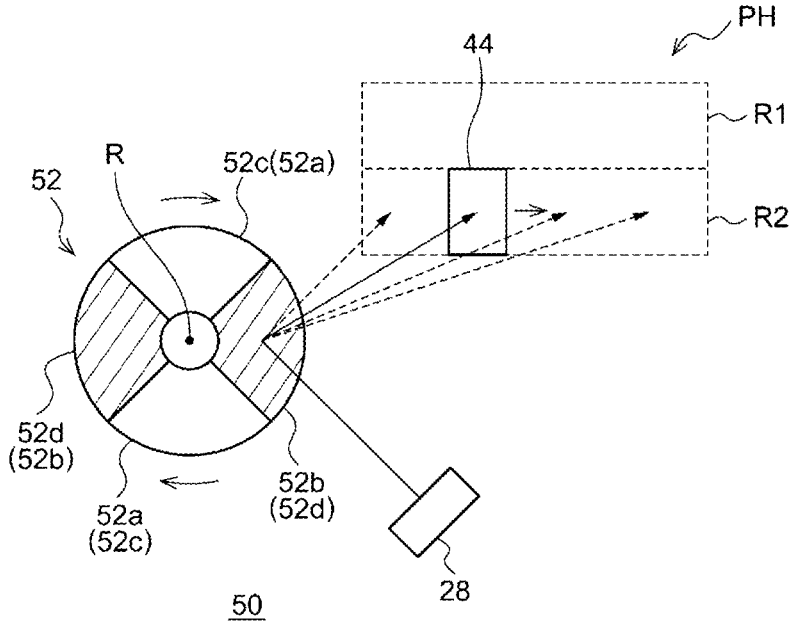

FIGS. 9A and 9B are schematic views for explaining the formation of a light distribution pattern by an optical unit according to a second embodiment.

An optical unit 50 according to the second embodiment is mainly different from the optical unit 40 according to the first embodiment in that a rotary reflector 52 includes four reflecting surfaces. The rotary reflector 52 is provided with a plurality of reflecting surfaces 52*a* to 52*d* such that the light of the LED 28 reflected by the rotary reflector rotating forms the desired light distribution pattern PH. The reflecting surfaces have first reflecting surfaces 52*a*, 52*c* forming the first partial region R1 located at the upper side of the light distribution pattern PH and second reflecting surfaces 52*b*, 52*d* forming the second partial region R2 different from the first partial region R1 and located at the lower side of the light distribution pattern PH.

The first reflecting surface 52*a* reflects the light emitted from the LED 28 and scans the first partial region R1 shown in FIG. 9A as the light source image 44 from left to right. When the rotary reflector 52 is further rotated, as shown in FIG. 9B, the second reflecting surface 52*b* reflects the light emitted from the LED 28 and scans the second partial region R2 shown in FIG. 9B as the light source image 44 from left to right. When the rotary reflector 52 is further rotated, as shown in FIG. 9A, the first reflecting surface 52*c* reflects the light emitted from the LED 28 and scans the first partial region R1 shown in FIG. 9A as the light source image 44 again from left to right. When the rotary reflector 52 is further rotated, as shown in FIG. 9B, the second reflecting surface 52*d* reflects the light emitted from the LED 28 and scans the second partial region R2 shown in FIG. 9B as the light source image 44 again from left to right.

In this way, the light distribution pattern PH is a combination of the first partial region R1 formed by scanning the light of the LED 28 reflected by the first reflecting surfaces 52*a*, 52*c* and the second partial region R2 formed by scanning the light of the LED 28 reflected by the second reflecting surfaces 52*b*, 52*d*.

Since the rotary reflector 52 according to the present embodiment is provided with four or more reflecting surfaces, a plurality of first reflecting surfaces 52*a*, 52*c* and a plurality of second reflecting surfaces 52*b*, 52*d* can be provided. As a result, since the first partial region R1 is scanned multiple times and the second partial region R2 is scanned multiple times while the rotary reflector 52 makes one revolution, the scanning frequency can be increased.

Further, in the rotary reflector 52, the first reflecting surfaces 52*a*, 52*c* and the second reflecting surfaces 52*b*, 52*d* are provided alternately in the circumferential direction. In this way, the eccentricity during rotation of the rotary reflector 52 can be further suppressed.

Hereinabove, the present invention has been described with reference to each of the above-described embodiments. However, the present invention is not limited to each of the above-described embodiments, but a suitable combination or substitution for the configurations of the embodiment is also intended to be included in the present invention. Further, based on the knowledge of those skilled in the art, the combination or the order of processing in each embodiment can be appropriately changed or a modification such as various design changes can be added to each embodiment. An embodiment to which such modification is added can be also included to the scope of the present invention.

In the optical units according to the above-described embodiments, the light distribution pattern is formed by combining two partial regions. However, the light distribution pattern may be formed by combining three or more partial regions. In this way, since the degree of freedom in the position, size and number of the light-shielding portion is increased, it is possible to realize the vehicle lamp capable of obtaining good forward visibility while reducing glare to the forward vehicle or pedestrian. Further, the size of each partial region may be the same or may be different. Further, a part of the partial region may overlap with other partial regions or the partial regions may be spaced apart from each other.

The invention claimed is:

1. An optical unit comprising:

a rotary reflector configured to rotate in one direction around a rotation axis while reflecting light emitted from a light source, wherein the rotary reflector comprises: a first reflecting surface and a second reflecting surface such that light emitted by the light source reflected by the rotary reflector rotating is configured to form a desired light distribution pattern, wherein the first reflecting surface is configured to form a first partial region of the light distribution pattern by scanning light in a scanning direction, and wherein the second reflecting surface is configured to form a second partial region of the light distribution pattern different from the first partial region in a direction that intersects the scanning direction.

2. An optical unit comprising:

a rotary reflector configured to rotate in one direction around a rotation axis while reflecting light emitted from a light source, wherein the rotary reflector is provided with a plurality of first reflecting surfaces and a plurality of second reflecting surfaces such that light emitted from the light source reflected by the rotary reflector rotating is configured to form a desired light distribution pattern, wherein each of the plurality of first reflecting surfaces is configured to form a first partial region of the light distribution pattern by scanning light in a scanning direction, wherein each of the plurality of second reflecting surfaces is configured to form a second partial region of the light distribution pattern different from the first partial region in a direction that intersects the scanning direction, and wherein the rotary reflector has equal numbers of the first reflecting surfaces and the second reflecting surfaces.

3. The optical unit according to claim 2, wherein the first reflecting surfaces and the second reflecting surfaces are alternately provided in a circumferential direction.

4. An optical unit comprising:

a projection lens having an optical axis; and a rotary reflector configured to rotate in one direction around a rotation axis while reflecting light emitted from a light source, wherein the rotary reflector comprises a first blade and a second blade such that light emitted by the light source reflected by the rotary reflector rotating is configured to form a desired light distribution pattern, wherein the first blade is configured to form a first partial region of the light distribution pattern by scanning light in a scanning direction, wherein a second blade is configured to form a second partial region of the light distribution pattern different from the first partial region in a direction that intersects the scanning direction, wherein first and second blades rotate around the rotation axis, and wherein each of the first and second blades has a shape in which an angle formed by the optical axis of the projection lens and reflecting surfaces of the first and second blades changes along the circumferential direction around the rotation axis.

5. The optical unit according to claim 1, wherein the direction that intersects the scanning direction is perpendicular to the scanning direction.

6. The optical unit according to claim 2, wherein the direction that intersects the scanning direction is perpendicular to the scanning direction.

7. The optical unit according to claim 4, wherein the direction that intersects the scanning direction is perpendicular to the scanning direction.

* * * * *